US005551222A

United States Patent [19]

Kawarabashi

[11] Patent Number: 5,551,222

[45] Date of Patent: Sep. 3, 1996

[54] DRIVING APPARATUS FOR TWO-FOR-ONE TWISTER HAVING ADVANTAGEOUSLY LOCATED SPEED CHANGE DEVICES

[75] Inventor: Tsukasa Kawarabashi, Kyoto, Japan

[73] Assignee: Murata Kikai Kabushiki Kaisha, Kyoto, Japan

[21] Appl. No.: 320,829

[22] Filed: Oct. 7, 1994

Related U.S. Application Data

[63] Continuation of Ser. No. 088,308, Jul. 7, 1993, abandoned.

[30] Foreign Application Priority Data

Jul. 9, 1992 [JP] Japan ..... 4-207474

[51] Int. Cl.[6] ..... D01H 13/00; D01H 9/14

[52] U.S. Cl. ..... 57/105; 57/93; 57/281

[58] Field of Search ..... 57/281, 104, 105, 57/93

[56] References Cited

U.S. PATENT DOCUMENTS

| | | | |
|---|---|---|---|
| 3,325,985 | 6/1967 | Bucher | 57/93 |
| 3,626,683 | 12/1971 | Scriven | 57/104 |
| 3,641,757 | 2/1972 | Rehn | 57/105 X |
| 3,738,095 | 6/1973 | Lohest | 57/100 |
| 4,330,987 | 5/1982 | Schippers et al. | 57/104 X |
| 4,332,129 | 6/1982 | Schippers et al. | 57/105 |
| 4,694,643 | 9/1987 | Wolf | 57/93 |
| 4,922,703 | 5/1990 | Matsui et al. | 57/93 |
| 4,928,476 | 5/1990 | Otoshima et al. | 57/281 X |

FOREIGN PATENT DOCUMENTS

| | | | |
|---|---|---|---|
| 1062599 | 12/1953 | France | 57/104 |
| 1286031 | 1/1962 | France | 57/104 |

*Primary Examiner*—William Stryjewski
*Attorney, Agent, or Firm*—Loeb & Loeb LLP

[57] ABSTRACT

A pair of tangential belts disposed for parallel movement on the left and right locations for individually driving a pair of left and right spindle trains disposed in a back-to-back relationship to each other are individually driven by means of a pair of motors at the opposite ends of a machine base, and a right take-up mechanism train is driven by a speed change gear connected to a driving pulley for a belt while a left take-up mechanism train is driven by another speed changing device connected to a turn pulley for a belt, the speed changing device and being disposed collectively at an end of the machine base.

4 Claims, 4 Drawing Sheets

DRIVING APPARATUS FOR TWO-FOR-ONE TWISTER HAVING ADVANTAGEOUSLY LOCATED SPEED CHANGE DEVICES

This is a continuation of application Ser. No. 08/088,308 filed on Jul. 7, 1993, now abandoned.

BACKGROUND OF THE INVENTION

1. Field of the Invention

This invention relates to a driving apparatus for a two-for-one twister wherein a left train and a right train each including a downwardly located spindle train and an upwardly located take-up mechanism train are disposed in a back-to-back relationship to each other.

2. Prior Art

The construction of a two-for-one twister of the type mentioned will be described with reference to FIGS. 3 and 4. Referring first to FIG. 4, the two-for-one twister 1 includes a right train 52 and a left train 53 each including a downwardly located spindle train 50 and an upwardly located take-up mechanism train 51 and disposed in a back-to-back symmetrical relationship to each other. Referring now to FIG. 3, a driving apparatus for the two-for-one twister includes a belt apparatus 9 for the spindle trains 50, and a speed changing device 10 for the take-up mechanism trains 51. The entire driving apparatus is driven by a motor 11 common to the right train 52 and the left train 53.

Referring to FIG. 3, the spindle train 50 has a structure wherein a spindle 3 extends outwardly from each of a plurality of covers 2 each provided for accommodating a supply yarn package therein. The spindles 3 are held in contact with the tangential belt 4 so that they are rotated at a high speed by the tangential belt 4. The spindles 3 in the left and right trains are driven by the single tangential belt 4 as seen from FIG. 5. A yarn supplied from each supply yarn package is introduced into a tension apparatus disposed above the corresponding spindle 3, in which tension is applied to it, and then, it is twisted by two twists while it is ballooned by a rotary disk which rotates together with the spindle 3.

Meanwhile, the take-up mechanism trains 51 are constructed such that each twisted yarn is taken over by a feed roller 8 and then traversed by a traverse guide 7 which is reciprocated, whereafter it is taken up onto a take-up package 5 which contacts with and is rotated by a corresponding drum 6. The left and right take-up mechanism trains 51 can be adjusted so as to provide different numbers of twists to yarns by way of a pair of different belt speed changing devices 30. To this end, a pair of pulleys 17 are disposed at different locations in a direction perpendicular to the plane of FIG. 3, and also a shaft 20 and several components having reference numbers beginning with 30 for the belt speed change bears are each provided in pair at locations in the direction perpendicular to the plane of FIG. 3. It is to be noted that a belt 18 for the two pulleys 17 extends to and around a common second pulley 14.

Subsequently, details of the driving apparatus for driving the belt apparatus 9 for the spindle trains and the speed changing device 10 for the take-up mechanism trains by the common motor 11 will be described. The driving motor 11 has an output shaft 12 on which a pair of first and second pulleys 13 and 14 are securely mounted, and a belt 16 extends between and around the first pulley 13 and a third pulley 15 while another belt 18 extends between and around the second pulley 14 and a fourth pulley 17. The third pulley 15 is securely mounted on a shaft 19, which is connected to the belt apparatus 9, and the fourth pulley 17 is securely mounted on another shaft 20, which is connected to the speed changing device 10.

The belt apparatus 9 for the spindle trains is constructed such that the tangential belt 4 of an endless configuration extends between and around a fifth pulley 21 serving as a driving pulley and a sixth pulley 22 serving as a turn pulley. The fifth pulley 21 and the third pulley 15 are securely mounted at the opposite ends of the shaft 19, and output power of the driving motor 11 is transmitted to the tangential belt 4 by way of the output shaft 12, the first pulley 13, the belt 16, the third pulley 15 and the fifth pulley 21 so that the belt 4 is circulated to rotate the spindles 3. As seen from FIG. 5 which is a sectional view taken along line V—V of FIG. 3, the left and right spindle trains 3 are held in rolling contact with both of the slackening side portion and the tensioning side portion of the tangential belt 4. A belt tensioner 23 is disposed to contact with the slackening side portion of the tangential belt 4.

The speed changing device 10 for the take-up mechanism trains has the following structure. Each of the fourth pulleys 17 is securely mounted at an end of the corresponding shaft 20, and the other end of the shaft 20 is connected to the speed change belt apparatus 30. A plurality of gear wheels are installed in a reduction box 31, and rotating power from an output shaft 32 of the speed change belt apparatus 30 is inputted to the reduction box 31. The reduction box 31 thus reduces the speed of the input rotating power at a fixed rate and changes the direction of rotation of the input rotating power. A seventh pulley 34 is securely mounted on an output shaft 33 of the reduction box 31. A belt 39 extends between and around the seventh pulley 34 and an eighth pulley 36 securely mounted on a support shaft 35 by way of a ninth pulley 38 securely mounted on another support shaft 37. The drums 6 are securely mounted on the support shaft 35 in a predetermined spaced relationship from each other, and a treble gear 40 is securely mounted at an end of the support shaft 35. Meanwhile, the feed rollers 8 are securely mounted on the other support shaft 37 in a predetermined spaced relationship from each other. A belt 43 extends between and around the treble pulley 40 and another treble pulley 42 securely mounted at an end of a shaft 41. The other end of the shaft 41 extends into a cam box 25, and the shaft 41 is connected to a grooved drum 46 by way of a pair of gear wheels 44 and 45. The drum 46 has a cam groove 47 formed thereon, and a cam shoe 48 is fitted in the cam groove 47. A reciprocatory rod 49 is securely mounted on the cam shoe 48, and the traverse guides 7 are Securely mounted on the rod 49 in a predetermined spaced relationship from each other. As seen from FIG. 4 which is a sectional view taken along line IV—IV of FIG. 3, the elements having reference numerals equal to and greater than 34 for the seventh pulley are disposed in the two left and right symmetrically arranged trains. With the construction described above, output power of the driving motor 11 is transmitted by way of the belt 18, the speed change belt apparatus 30, the reduction box 31 and the belt 39 to the support shaft 35 for the drums 6 and the support shaft 37 for the feed rollers 8 to rotate the drums 6 and the feed rollers 8. Rotation of the support shaft 35 is further transmitted by way of the belt 43 to the grooved drum 46 to rotate the drum 46, whereupon the cam shoe 48 is moved along the groove 47 of the drum 46 to reciprocate the traverse guides 7.

Since the driving apparatus for a two-for-one twister described above has the structure wherein the left and right trains are driven by the common motor, neither of the left and right trains can be driven solely. Meanwhile, as the tendency of production of many kinds by small amounts in recent years increases, such a demand as to drive individually each of the left and right trains 52 and 53 of FIG. 4 has arisen. Here, it seems a promising idea to, for example, dispose the belt apparatus 9 for the right spindle train and the speed changing device 10 for the right take-up mechanism train at an end of the machine base while the belt apparatus 9 and the speed change gear 10 for the left train are disposed at the other end of the machine base. However, this requires a pair of driving apparatus disposed at the opposite ends of the machine base, and consequently, there is a problem in that the locations for maintenance are dispersed. Particularly, the speed changing device 10 for the take-up mechanism trains involves a large number of gear wheels, belts and like elements, and accordingly, the location of it is dispersed, resulting in inconvenience for maintenance. Also, it seems promising to dispose a pair of belt apparatus 9 for the left and right trains separately on the opposite sides of the machine base and connect a pair of speed changing devices 10 for the left and right trains to one of the belt apparatus 9 for the spindle trains. However, although the speed changing devices 10 for the left and right spindle trains start or stop simultaneously with each other, the belt apparatus 9 for the left and right trains 9 start or stop at different timings from each other, and accordingly, non-twisted portions or excessively twisted portions may possibly be produced at starting or terminating ends of yarns.

SUMMARY OF THE INVENTION

The present invention has been made in view of such problems of the prior art as described above, and it is an object of the present invention to provide a driving apparatus for a two-for-one twister which is comparatively compact and easy to undergo maintenance and has no possibility that non-twisted portions or excessively twisted portions may be produced on yarns upon starting or stopping of the driving apparatus.

In order to attain the object described above, according to the present invention, there is provided a driving apparatus for a two-for-one twister, wherein a pair of tangential belts disposed for parallel movement on the left and right locations for individually driving a pair of downwardly located left and right spindle trains disposed in a back-to-back relationship to each other are individually driven by means of a pair of motors at lower locations at the opposite ends of a machine base, and a pair of upwardly located left and right take-up mechanism trains are individually driven by way of a pair of left and right speed changing devices which are disposed collectively at an end of the machine base and one of which is connected to the driving side of one of the belts while the other speed changing device is connected to the turn side of the other belt. Further, the driving apparatus is suitable wherein an unloading port for a take-up package conveyor disposed between the left and light take-up mechanism trains is provided at the other end of the machine base.

While the spindle trains are driven by the motors on the opposite ends of the machine base, since the take-up mechanism trains are driven by way of the speed change mechanisms individually connected to the turn side and the driving side of the one and the other of the tangential belts disposed for parallel movement on the left and right locations which are driven by the motors, the speed changing devices of a complicated construction are collected at the one end of the machine base, and individual operation of each of the left and right trains can be performed synchronously by the spindle train and the take-up mechanism train. Further, the speed changing devices disposed collectively at the one end of the machine base does not interfere with the take-up package conveyor, and consequently, the discharging opening is assured at the other end of the machine base.

DETAILED DESCRIPTION OF PREFERRED EMBODIMENT

Figure 1:
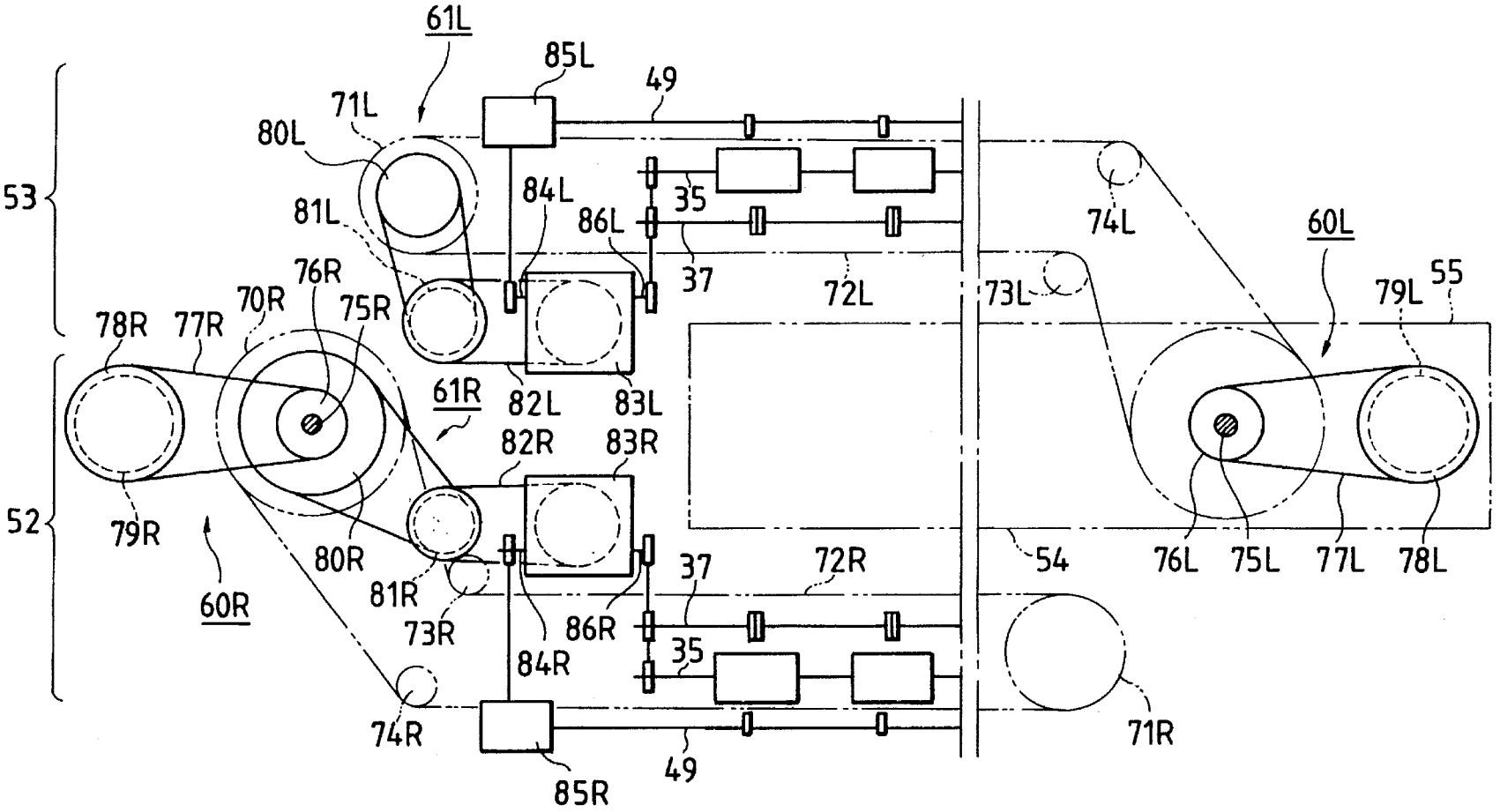
FIG. 1 is a driving system diagram of a driving apparatus for a two-for-one twister of the present invention.

In the following, an embodiment of the present invention will be described with reference to the drawings. FIG. 1 is a driving system diagram of a driving apparatus for a two-for-one twister of the present invention.

Referring to FIG. 1, reference character 60R denotes a belt apparatus for a right spindle train, 61R a speed changing device for a right take-up mechanism train, 60L a belt apparatus for a left spindle train, and 61L a speed changing device for a left take-up apparatus.

The belt apparatus 60L and 60R for the left and right spindle trains are disposed symmetrically with respect to the center of a machine base not shown. The belt apparatus 60R for the right spindle train has such a construction as described below. A tangential belt 72R extends parallelly between a driving pulley 70R and a turn pulley 71R under the guidance of a pair suitable guide pulleys 73R and 74R, and the driving pulley 70R is driven by way of a shaft 75R, a pulley 76R and a belt 77R by another pulley 78R secured to a motor 79R. Also the belt apparatus 60L for the left spindle train has a similar construction, and corresponding components are denoted by like reference numerals with the suffix L added thereto and overlapping description of them is omitted herein. The left and right tangential belts 72L and 72R are disposed so as to extend in parallel to each other on the left and right locations as seen in FIG. 1.

The speed changing devices 61L and 61R for the left and right take-up mechanism trains are disposed in a left-and-right symmetrical relationship with each other with respect to the center line of a machine bed not shown. The speed changing device 61R for the right take-up mechanism train is supplied with power from a pulley 80R coaxial with the driving pulley 70R while the other speed changing device 61L for the left take-up mechanism train is supplied with power from a third pulley 80L coaxial with the turn pulley 71L, and the speed changing devices 61L and 61R are disposed collectively at an end of the machine base not shown. A discharging opening 55 for a take-up package conveyor 54 is provided at the other end of the machine base. The speed changing device 61R for the right take-up mechanism train is constructed in the following manner. Power is transmitted from the pulley 80R to a pulley 81R by way of a belt to drive a speed change belt apparatus 82R and a reduction box 83R. A cam box 85R is driven from a first output shaft 84R of the reduction box 83R to reciprocate a reciprocatory rod 49. Meanwhile, a second output shaft 86R of the reduction box 83R rotates support shafts 35 and 37 by way of suitable pulleys and belts. Also the speed changing device 61L for the left take-up mechanism train has a similar construction, and corresponding components are denoted by like reference numerals with the suffix L added thereto and overlapping description of them is omitted herein.

Figure 2:
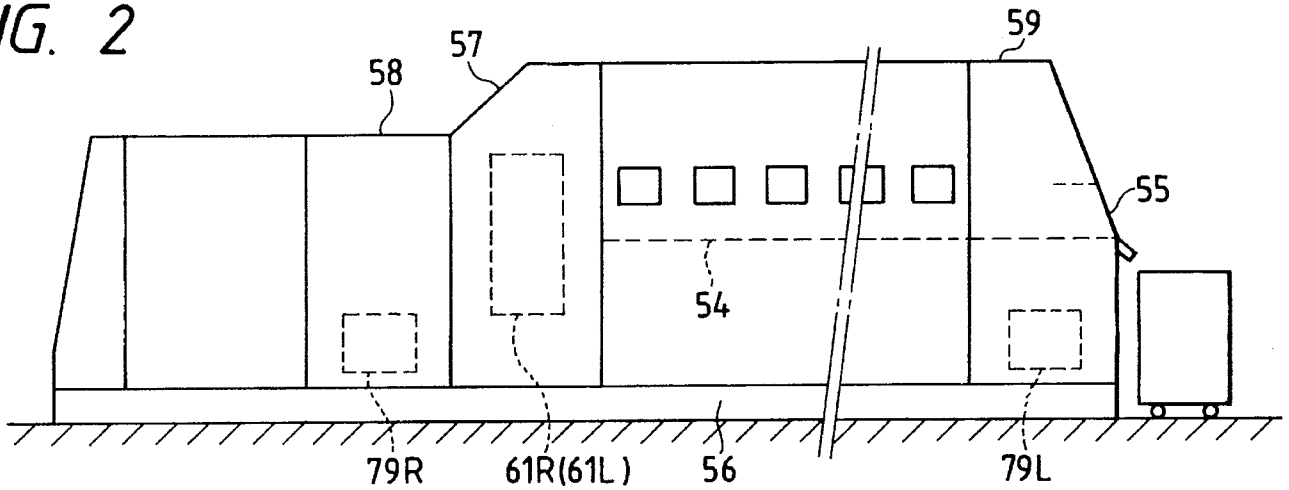
FIG. 2 is a side elevational view of the entire two-for-one twister to which the driving apparatus of the present invention is applied.
Figure 5:
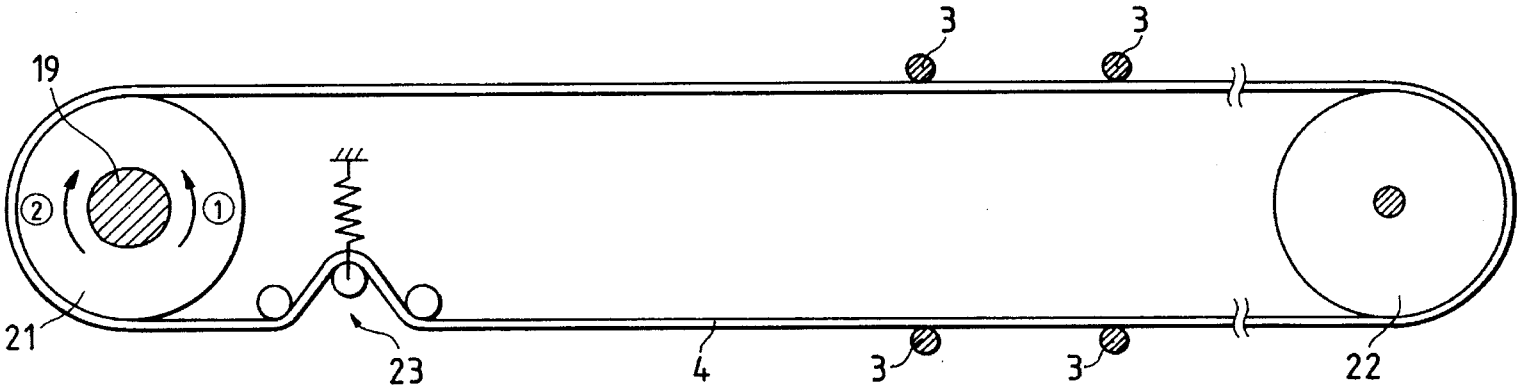
FIG. 5 PRIOR ART
FIG. 5 is a sectional view taken along line V—V of FIG. 3.
Figure 3:
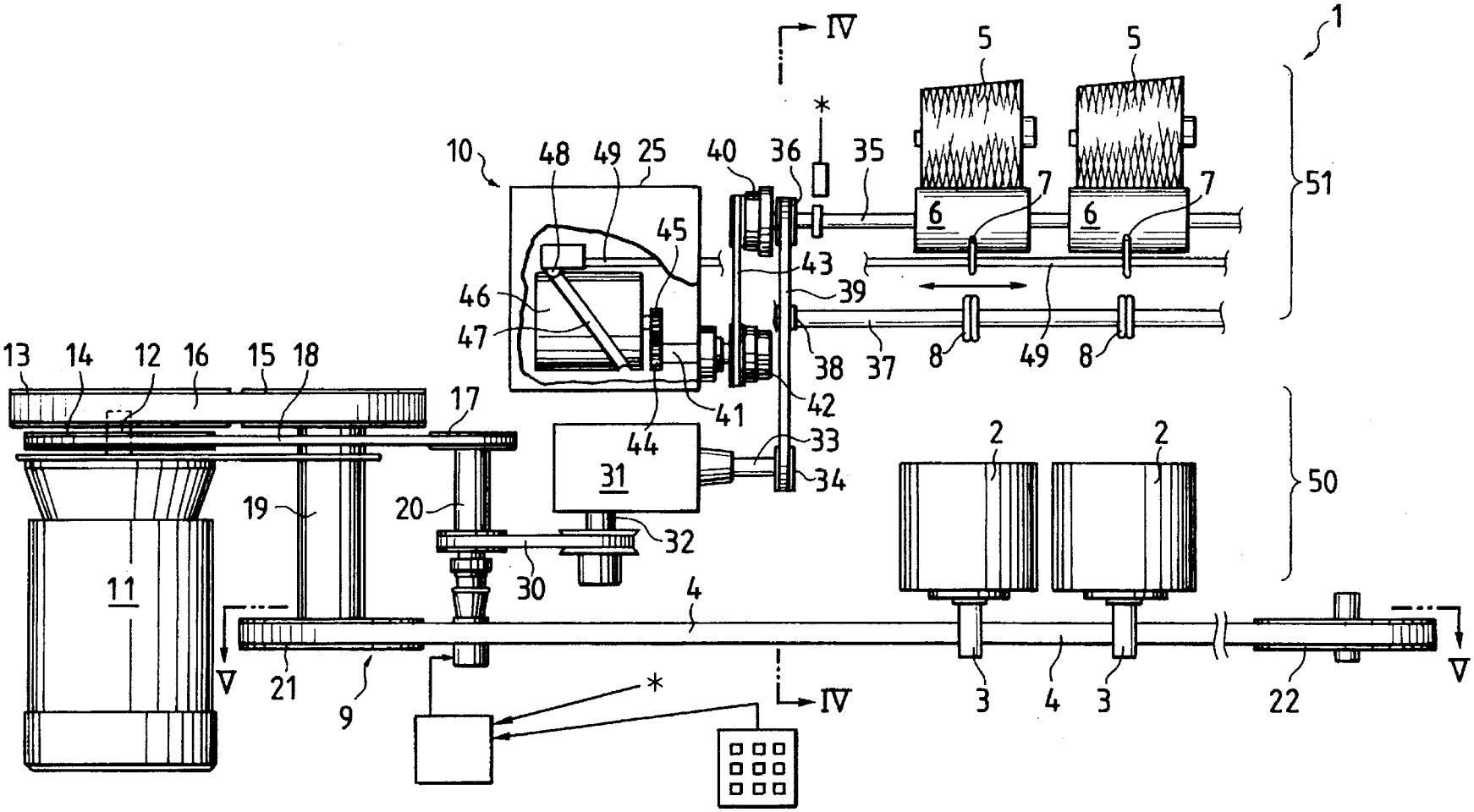
FIG. 3 PRIOR ART
FIG. 3 is a schematic view showing an arrangement of components of a conventional two-for-one twister and a driving apparatus.
Figure 4:
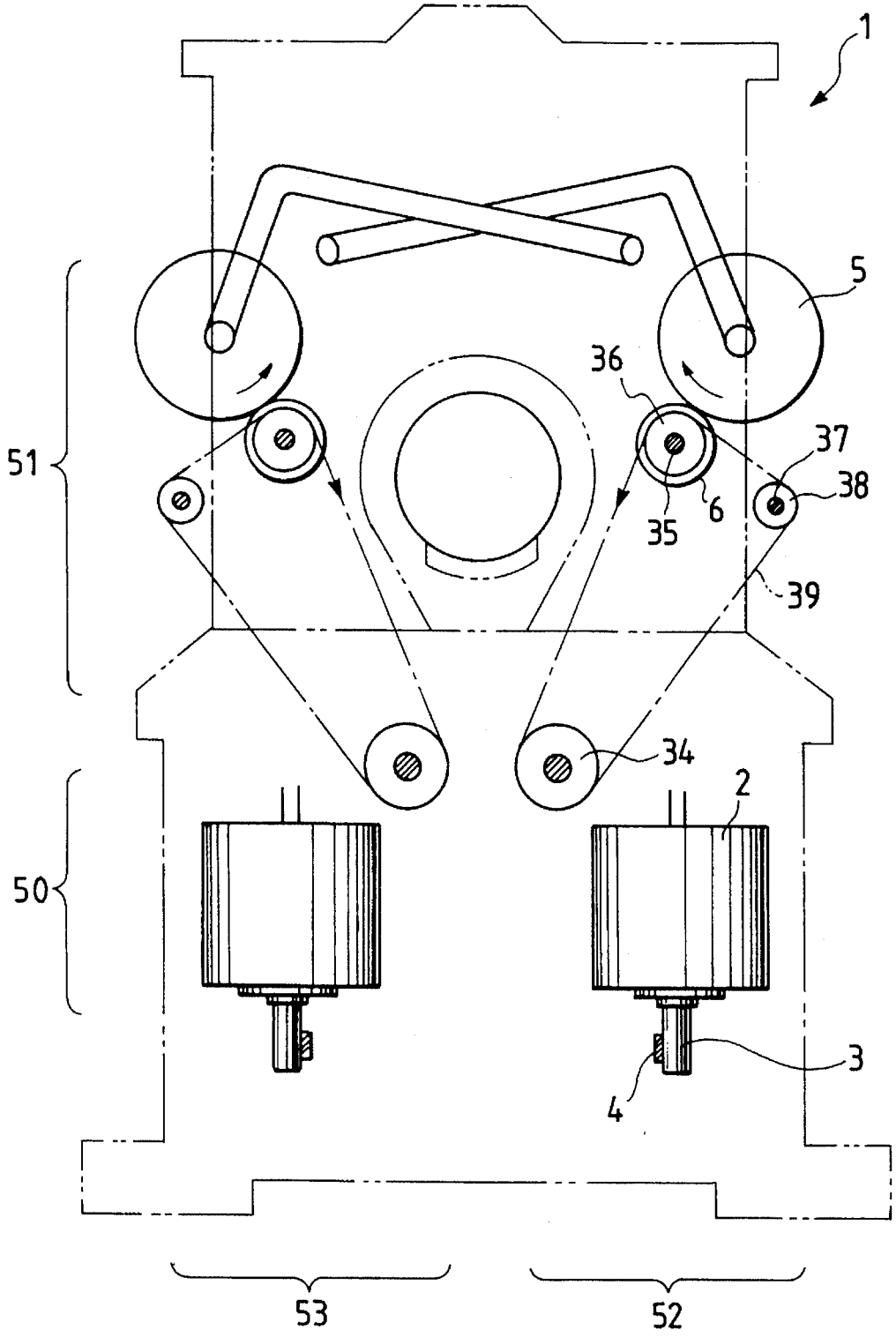
FIG. 4 PRIOR ART
FIG. 4 is a sectional view taken along line IV—IV of FIG. 3.

In the driving apparatus of the construction described above, since the belt apparatus 60R for the right spindle train and the speed changing device 61R for the right take-up mechanism train are driven by the common motor 79R, synchronized starting and stopping operations of the spindle train and the take-up mechanism train are assured, and non-twisted portions or excessively twisted portions of yarns are not produced upon starting or stopping of the twister. Further, the right train 52 and the left train 53 are completely independent of each other, and the two-for-one twister can cope flexibly with the production of many types by small amounts by individual operation of the right train 52 or the left train 53 or some other means. Further, as shown in FIG. 2, a box 57 in which the speed changing devices 61L and 61R for the left and right take-up mechanism trains can be accommodated collectively is provided at one end of a machine base 56, and another box 58 for the motor 79R for the right train which extends outwardly to the greatest extent is provided at the one end of the machine base 56 while a further box 58 for the motor 79L for the left train which similarly extends outwardly to the greatest extent is provided at the other end of the machine base 56. The discharging opening 55 for the conveyor 54 is opened on the other end side of the machine base 56. Accordingly, the speed changing devices gears 61L and 61R for the left and right take-up mechanism trains, which perform complicated speed changing operations, are accommodated collectively in the box 57, which facilitates maintenance of them. Further, the speed changing devices 61L and 61R for the left and right take-up mechanism trains collected in this manner do not interfere with the discharging opening. 55 for the conveyor 54, and even with a two-for-one twister of the type wherein the left and right trains are driven independently of each other, reduction in space can be achieved by employing a take-up package conveyor disposed between the left and right take-up mechanism trains as seen from FIG. 4.

With the driving apparatus for a two-for-one twister according to the present invention, while the left and right spindle trains are individually driven by the motors at the opposite ends of the machine base, the left and right take-up mechanism trains are driven by the speed changing devices connected to the turn side and the driving side of the tangential belts which are disposed parallelly to each other on the left and right locations and are driven by the motors, the speed changing devices of a complicated construction are disposed collectively at one end of the machine base, and since individual operation of each of the left and right trains can be performed synchronously by the spindle train and the take-up mechanism train, the driving apparatus can cope with production of many types by small amounts by the twister without production of untwisted portions or excessively twisted portions of yarns. Further, the speed changing devices disposed collectively at the one end of the machine base do not interfere with the take-up package conveyor, and the discharging opening can be assured at the other end of the machine base. Accordingly, a conveyor of the space saving type can be adopted reasonably.

What is claimed is:

1. A two-for-one twister defining a first end and a second end, the two-for-one twister comprising:

a first and second row of spindles, a first and second row of take-up mechanisms, a first belt for driving the first row of spindles, a second belt for driving the second row of spindles, a first motor for driving the first belt, a second motor for driving the second belt, the first motor being disposed substantially adjacent the first end of the two-for-one twister, the second motor being disposed substantially adjacent the second end of the two-for-one twister, a first speed changing mechanism in communication with the first belt for changing the speed of the first row of take-up mechanisms, a second speed changing mechanism in communication with the second belt for changing the speed of the second row of take-up mechanisms, the first and second speed changing mechanisms being disposed substantially adjacent the first end of the two-for-one twister.

2. The apparatus of claim 1, comprising:

a package conveyor disposed substantially between the first and second rows of take-up mechanisms, and an unloading port for the package conveyor disposed at at least one of the first and second ends of the two-for-one twister.

3. The apparatus of claim 1, wherein the first belt has a driving end, wherein the second belt has a turning end, wherein the first speed changing device is connected to the driving end of the first belt, and wherein the second speed changing device is connected to the turning end of the second belt.

4. The apparatus of claim 1, further comprising an enclosure for enclosing both the first and second speed changing devices.

* * * * *